United States Patent [19]
Lenk et al.
[11] 4,230,285
[45] Oct. 28, 1980

[54] TRAVERSING DEVICE FOR THREAD WINDING APPARATUS

[75] Inventors: Erich Lenk, Remscheid, Fed. Rep. of Germany; Donald J. Dobbins, Waxhaw, N.C.

[73] Assignee: Barmag Barmer Maschinenfabrik AG, Remscheid-Lennep, Fed. Rep. of Germany

[21] Appl. No.: 79,047

[22] Filed: Sep. 26, 1979

[30] Foreign Application Priority Data

Oct. 4, 1978 [DE] Fed. Rep. of Germany ..... 2843208

[51] Int. Cl.[3] ..... B65H 54/28
[52] U.S. Cl. ..... 242/43 R; 242/158.3
[58] Field of Search ..... 242/43 R, 158.3, 158.5; 74/55, 56, 57

[56] References Cited

U.S. PATENT DOCUMENTS

| | | | |
|---|---|---|---|
| 3,074,286 | 1/1963 | Altice et al. | 242/43 R X |
| 3,248,064 | 4/1966 | Rollings | 242/43 R |
| 3,373,949 | 3/1968 | Swallow | 242/43 R |
| 3,401,894 | 9/1968 | Campbell, Jr. | 242/43 R |
| 3,664,596 | 5/1972 | Lenk | 242/43 R |
| 3,861,607 | 1/1975 | Schippers et al. | 242/43 R |

*Primary Examiner*—Stanley N. Gilreath
*Attorney, Agent, or Firm*—John H. Shurtleff

[57] ABSTRACT

Traversing device in a thread winding apparatus having a housing encircling a rotatably driven cam roller which operates a traversing thread guide means mounted to project outwardly through a traverse slot or opening in the housing, with means to generate and direct an air stream to flow outwardly from said traverse slot in order to prevent the thread being wound or broken filaments thereof from entering the housing and being wrapped around the cam roller or interfering with the traversing thread guide.

10 Claims, 4 Drawing Figures

TRAVERSING DEVICE FOR THREAD WINDING APPARATUS

BACKGROUND OF THE INVENTION

This invention relates to a winding or spooling apparatus for threads and in particular, for synthetic filaments or fibers, which requires the use of a traversing device such as that disclosed in U.S. Pat. No. 3,664,596 wherein the traversing thread guide means has an arcuately-shaped shoe as a cam-following element adapted to ride in the reversing spiral groove or grooves of a rotatable cam roller while also being guided for reciprocation in a straight line by the engagement of a plate-like slide piece on the thread guide arranged to engage in two parallel guide grooves acting as rectilinear guide rails, each having a pair of inner and outer lips or edges which form the sides of the respective grooves. Such a traversing device is conveniently arranged within a casing or housing having an elongated slot extending axially parallel to the cam roller with the oppositely facing longitudinal edges of the slot providing the two parallel guide grooves or guide rail means for the slide piece of the thread guide.

In the winding of threads that reach the traversing device in a loose association, as is the case with untwisted or only slightly twisted synthetic fibers and especially those fibers consisting of individual continuous filaments, it frequently occurs that with any thread breakage a thread end is drawn into the traversing device and forms a so-called "winder" on the cam roller. This severe entanglement of the roller can lead to the destruction of the traversing device. Moreover, the removal of the winder is very difficult and time consuming.

SUMMARY OF THE INVENTION

It is an object of the present invention to provide the above-described type of traversing device with a number of suitable means for producing an air stream which will flow outwardly from the traverse slot of the housing substantially enclosing the traversing mechanism, thereby preventing any portion of the thread as it is wound from entering the housing. Certain embodiments of the means acting to generate and direct the air stream outwardly from the slot are especially preferred.

For example, it was found to be sufficient to provide the housing of the traversing device with one or more holes or openings on the side away from the traverse slot. This embodiment leads, in particular, to the emergence of an air stream from the traverse slot when the cam roller is rotated at a sufficiently high speed, e.g. as often required in rapid winding operations.

Another useful embodiment of the invention resides in the use of a compressed air source connected to the housing which is then closed off substantially airtight except for the traverse slot. The compressed air is directed to flow outwardly from the traverse slot by any suitable arrangement or position of a feed line into or along the housing.

An especially advantageous embodiment of the traversing device according to the invention is one which includes a baffle strip or a similar baffle or dam means arranged behind or along the inner rear edge of the traverse slot, as viewed in the direction of rotational movement of the cam roller, i.e. the movement of its peripherally rotating surface, said strip or the like being firmly joined or made integral with the wall of the housing and extending radially inwardly very nearly to the outer circumference or periphery of the cam roller. In axial direction this baffle strip can extend over the entire length of the cam roller or else over partial lengths which exhibit a special tendency to suck in the thread through the traverse slot. The exact position may be determined, if necessary, by routine observation and experimentation. By using a detachable baffle strip or similar baffle means, the same traversing device is readily adapted to different thread winding operations. The baffle strip is most conveniently fastened to the rear edge of the traverse slot and may even form at least part of this rear edge.

The baffle strip in the preferred embodiment of the invention causes the air carried along by the grooved cam roller to be stripped off or dammed up so that a pressure head arises in front of the strip which in turn directs the air flow outwardly through the traverse slot. In this use of the rapidly rotating cam roller to generate the air stream, it is desirable to provide at least one additional opening in the housing for the entry of the air.

All of the embodiments of the invention are adapted to generate a steady and defined air flow through the traverse slot or at least outwardly therefrom without requiring any substantial expenditure for mechanical parts or operational energy.

THE DRAWINGS

The invention is described in detail with the aid of the accompanying drawing in which.

DESCRIPTION OF EMBODIMENTS OF THE INVENTION

Figure 1:
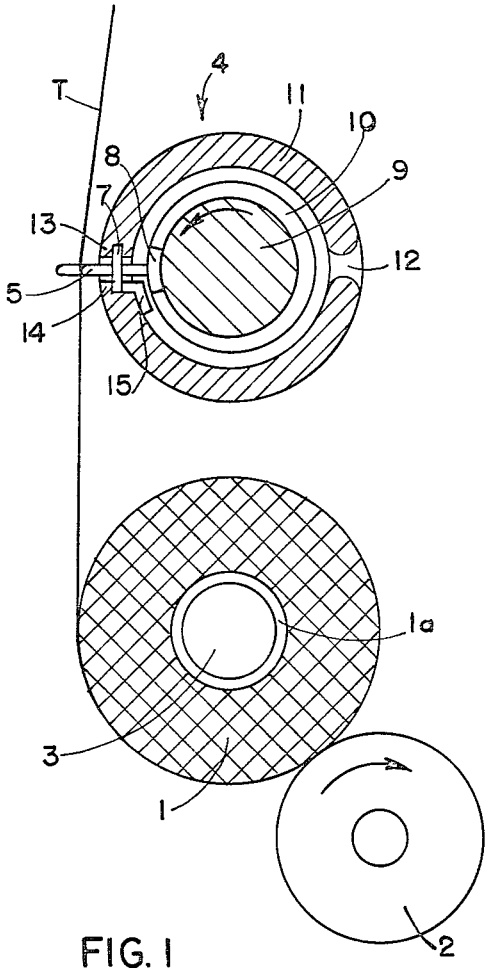
FIG. 1 is a cross-sectional and partly schematic view taken through a winding apparatus including a housed or encased traversing device which directs the thread onto a roller driven bobbin.

With reference to the drawing, the winding apparatus of the invention includes the cross-wound bobbin 1 which is mounted on a suitable chucking spindle 3 for free rotation and is driven by the drive roller 2 which remains in direct rolling contact with the bobbin package being formed.

The traversing device 4, representing one preferred embodiment of the invention, includes the traversing thread guide element 5, by means of which the thread T is reciprocated over the bobbin length. The thread guide 5 runs back and forth in a straight line in the narrow, elongated, rectilinear traverse slot or opening 6 of the housing 11. The inner end of the thread guide 5 has an arcuate foot or shuttle 8 which acts as a cam follower, being engaged by the cam roller 9 and guided in the pattern set by the reversing spiral groove 10.

The cam roller 9 is preferably driven by a motor independently of the friction drive roller 2, usually with the cam roller 9 running at a speed slightly higher than the drive roller 2. See, for example, the detailed description of a similar traversing device in U.S. Pat. No. 3,861,607, especially FIG. 7 thereof. This preferred cam roller and traversing thread guide arrangement is that shown in U.S. Pat. No. 3,664,596, the disclosure of which is therefore incorporated herein by reference as fully as if set forth in its entirety. Traversing devices of this type are particularly adapted to high speed winding operations, e.g. thread winding speeds of 1,500–4,000 meters/minute and traversing speeds of the thread guide element along the traverse slot of the thread guide element up to about 600 meters/minute.

Figure 4:
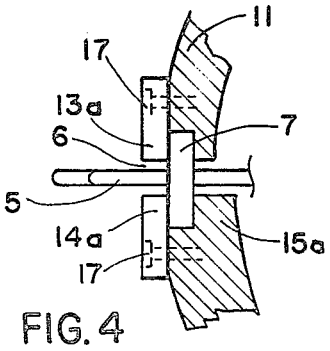
FIG. 4 is an enlarged cross-sectional view of a portion of another traversing device to illustrate another means of detaching part of the traverse slot.

The cam roller 9 rotates in the direction of the arrow, and with reference to this direction of rotation, the front and rear guide lips or edges 13 and 14 of slot 6 support the traversing thread guide 5 in its reciprocating path by means of the slide plate 7 riding in the opposing grooves of front edge 13 and rear edge 14, respectively. As indicated in FIG. 4, one or both of the slot lips or edges may be detachably mounted, e.g. the outer lips 13*a* and 14*a*, using any suitable fastening means as indicated by the bolts 17 which enter into the housing 11. The inner rear lip or edge 15 as shown in FIG. 1 may be removably fastened in the same manner while also serving as an air baffle means to block off or dam the annular concentric space formed between the inner wall of housing 11 and the outer peripheral surface of cam roller 9.

Figure 2:
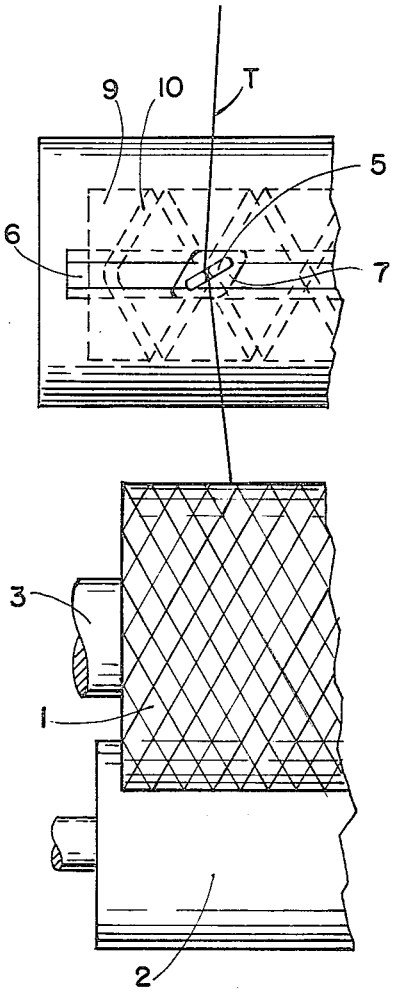
FIG. 2 is a partial front elevation of the winding apparatus of FIG. 1.

In the embodiment shown in FIGS. 1 and 2, the casing or housing 11 of the traversing device has on its back side opposite the traverse slot 6 or a hole or a series of several openings 12, preferably over a certain length represented by the cam roller 9. It should be noted that such opening or openings need not be in the form of an elongated slot or slit. It is also possible to use individual holes arranged with a certain spacing from one another. Especially when operating at high rotational speeds, these holes or openings as air entry ports or inlets are sufficient to generate an air stream produced entirely by the rapidly rotating cam roller 9, whereby air drawn in through the holes 12 emerges again through the traverse slot 6.

It is also possible, however, as shown in FIG. 1, for this space between grooved cam roller 9 and the housing 11, in a position extending approximately along the inner rear slot edge 14, to be filled or blocked off by a baffle strip 15 or a similar accumulating or damming member, which is removable fastened to the housing 11 to cooperate with the front lip portion of the slot edge 14 and to extend radially inwardly nearly to the outermost circumference of the cam roller 9. This baffle strip 15 acts as a drum or deflector whereby air carried along by the grooved surface of the cam roller 9 is stripped off and directed radially outwardly through the slot 6. In front of the traverse slot 6, a pressure head is formed by the baffle strip 15 which thus causes the air stream to emerge from the slot 6.

The outer end of the thread guide 5 has a conventional eyelet, loop, slit or the like to engage the thread T in running contact, using smooth rounded surfaces to reduce thread damage as much as possible. In spite of such precautions, individual filaments frequently break or are so loosely held in the running length of thread as to be caught up and carried inside the housing of conventional traversing devices, sometimes with disasterous results in the formation of a winder on the cam roller.

By means of the traversing device according to the present invention it has been possible to completely avoid this winder formation on the cam roller 9 even though thread breakage may still occur. In handling synthetic fibers of filamentary yarns containing a large number of very fine filaments, such winders have been substantially eliminated. By dimensioning the gap spacing between the free inner end of the baffle strip or similar damming member 15 and the outer surface of the cam roller 9, the air stream emerging from the slot 6 can be regulated in such a way as to completely prevent individual fibers or filaments from entering the housing. At the same time, the speed of this air stream is kept low enough so that it is not troublesome in causing the thread to spread out or to become dislodged in a secure guidance by the thread guide 5.

Figure 3:
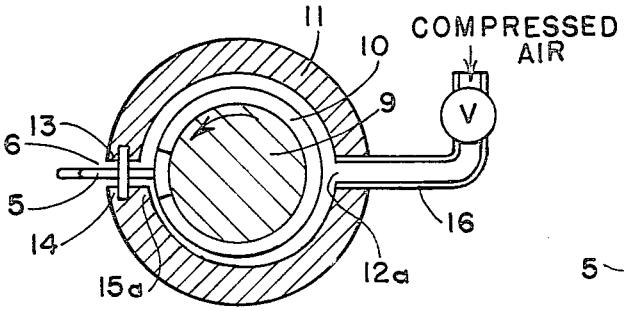
FIG. 3 is a partly schematic cross-section of a different embodiment of the traversing device wherein compressed air is fed into the housing encasing the cam roller.

The particular housing 11 represented in FIG. 3 as distinguished in providing an interior annular space in the form of a sickle, as seen in cross-section, i.e. so that the annular gap widens gradually directly behind the slot 6 by an enlarged but gradually reduced integral segment 15*a* of the housing 11. The air stream in this embodiment is fed in through the feed opening 12*a* of the compressed air line 16 to pass around the cam roller 9, and it is preferable to include a baffle means such as 15*a* so that the stream of air is again blocked and directed outwardly through the traverse slot 6. When using the baffle strip or enlargement 15 or 15*a*, one need not supply compressed air as in FIG. 3, but this particular combination of features is especially advantageous in providing an accurately adjusted flow rate for the stream of air under a wide variety of winding conditions.

It should also be noted that the baffle member, which is used for blocking the circulating air stream in accordance with the invention, need not be mounted directly on the rear lip or edge 14 of the traverse slot. It is generally sufficient to place the baffle member or members in the annular space at any point behind the slot 6 and in front of the opening 12, as viewed with respect to the direction of surface rotation of the cam roller 9. For example, the baffle strip can be located halfway between slot 6 and opening 12 as a vertical plate or the like mounted vertically at the bottom of the housing 11 and adjustably slidable into different blocking positions, i.e. with means to set its upper free end at any desired gap distance from the outermost circumference of the cam roller 9.

In order to change the cam roller, the traversing thread guide and/or the baffle member, it is desirable to provide a traverse slot 6 formed by removable or interchangeable elements, e.g. using an outer face plate or two separate outer slot lips 13*a* and 14*a* which also act to form one side of the upper and lower guide grooves for the slide plate 7. Upon removal of the fastening bolts 17, these outer lips 13*a* and 14*a* are detached and the thread guide 5 can then be withdrawn through the slot 6. The cam roller 9 is preferably withdrawn axially from one detachable end of the housing 11.

The traversing device of the invention is readily adapted to any traversing mechanism regardless of its construction or operation provided that it meets the usual requirements of thread winding apparatus and can be placed within a housing equipped with a traverse slot for the reciprocating thread guide. Moreover, other variations and changes can be made in the individual parts of the present invention without departing from the spirit or scope of the invention.

The invention is hereby claimed as follows:

1. In a thread winding apparatus having a traversing device which includes a housing, a rotatably driven cam roller mounted within said housing, traversing thread guide means engaging said cam roller for reciprocating movement along said roller and projecting outwardly of said housing to receive and guide the thread being wound, and an enlongated traverse slot in said housing arranged to extend along the cam roller to provide an opening in which said thread guide means reciprocates in a substantially straight line, the improvement which comprises:

means to generate and direct an air stream to flow outwardly from said slot, thereby preventing any portion of the thread as it is wound from entering the housing.

2. Apparatus as claimed in claim 1 wherein said housing contains at least one opening in addition to said traverse slot, said at least one additional opening being arranged for entry of air into the housing to form a stream emerging from said slot.

3. Apparatus as claimed in claim 1 wherein said means to generate and direct said air stream includes a compressed air supply connected to said housing.

4. Apparatus as claimed in claim 1 wherein a baffle strip is arranged in the space between the inner wall of the housing and the cam roller and fills said space sufficiently to direct air flow outwardly through said traverse slot.

5. Apparatus as claimed in claim 4 wherein said baffle strip is arranged to extend approximately along the rear edge of the traverse slot, viewed in the direction of rotational movement of the cam roller and nearly completely fills the space between said rear edge and the cam roller.

6. Apparatus as claimed in claim 5 wherein said baffle strip is detachably mounted on said housing and forms a portion of the rear edge of said traverse slot.

7. Apparatus as claimed in claim 5 wherein said baffle strip presents at first a narrow air gap at about the rear edge of the traverse slot and then widens as viewed in the direction of rotational movement of said cam roller.

8. Apparatus as claimed in claim 7 wherein said baffle strip is formed as an integral part of the inner rear edge of said traverse slot.

9. Apparatus as claimed in claim 2 wherein said housing encircles said cam roller with a defined radial spacing, and said means to generate and direct said air stream includes a cam roller having a reversing spiral groove thereon to operate the traversing thread guide means, saidd cam roller being adapted for rotational speed which is rapid enough to generate the air stream in the housing in a direction inwardly from said at least one entry opening, around a portion of the inner circumference of the housing and then emerging outwardly from said traverse slot.

10. Apparatus as claimed in claim 9 including baffle means arranged in the space between the inner wall of the housing and the cam roller to dam and direct the flow of air outwardly through said traverse slot.

* * * * *